US005478097A

United States Patent [19]

Forma

[11] Patent Number: 5,478,097

[45] Date of Patent: Dec. 26, 1995

[54] GOLF BAG WITH RETRACTABLE WHEEL SYSTEM

[76] Inventor: Warren Forma, 125 E. 63rd St., New York, N.Y. 10021

[21] Appl. No.: 328,420

[22] Filed: Oct. 25, 1994

[51] Int. Cl.[6] ..... B62B 1/12; B62B 1/16

[52] U.S. Cl. ..... 280/47.26; 280/30; 280/DIG. 6

[58] Field of Search ..... 280/47.18, 47.19, 280/47.26, DIG. 6, 43.1, 43.24, 30; 301/5.1

[56] References Cited

U.S. PATENT DOCUMENTS

| | | | |
|---|---|---|---|
| 2,124,345 | 7/1938 | Grange | 301/5.1 X |
| 2,428,954 | 10/1947 | Apblett et al. | 280/DIG. 6 X |
| 2,438,078 | 3/1948 | Sutphen | 280/DIG. 6 X |
| 2,599,354 | 6/1952 | Stableford . | |
| 2,647,762 | 8/1953 | Jamieson et al. . | |
| 2,726,094 | 12/1955 | Leystra . | |
| 2,760,782 | 8/1956 | Hartzell | 280/DIG. 6 X |
| 2,857,168 | 10/1958 | Neaverson et al. | 280/DIG. 6 X |
| 3,150,881 | 9/1964 | Skyock . | |
| 4,012,051 | 3/1977 | Embinder | 280/DIG. 6 X |
| 4,017,091 | 4/1977 | Wallen | 280/DIG. 6 X |
| 4,382,612 | 5/1983 | Larkin . | |
| 4,629,202 | 12/1986 | Nelson et al. | 280/DIG. 6 X |
| 4,822,071 | 4/1989 | Widegren . | |
| 4,832,362 | 5/1989 | Chen | 280/DIG. 6 X |
| 4,836,565 | 6/1989 | Catalo | 280/DIG. 6 X |
| 4,890,856 | 1/1990 | Mursch et al. . | |
| 4,911,465 | 3/1990 | Hauer | 280/47.26 X |
| 5,168,992 | 12/1992 | Bowdy | 280/DIG. 6 X |
| 5,267,750 | 12/1993 | Thompson . | |

FOREIGN PATENT DOCUMENTS

| | | | |
|---|---|---|---|
| 607387 | 8/1948 | United Kingdom | 280/DIG. 6 |

*Primary Examiner*—Brian L. Johnson
*Attorney, Agent, or Firm*—Collard & Roe

[57] ABSTRACT

A mobile golf bag having telescoping wheel supports and wheels mounted to the bottom portion of the golf club container. The telescoping wheel supports have a first extended operable position and a second retracted storage position.

10 Claims, 4 Drawing Sheets

GOLF BAG WITH RETRACTABLE WHEEL SYSTEM

BACKGROUND OF THE INVENTION

1. Field of the Invention

The present invention relates to golf bags. More particularly, it relates to a golf bag having telescoping wheels for pulling the golf bag.

2. The Prior Art

While the golf bag is convenient for its portability, facilitating carrying around from location to location, it becomes quite cumbersome when using it on the golf course and carrying it from green to green. As a result, golf carts are frequently used on the golf course where the golf bag is placed in or attached to the cart to permit wheeling about the golf course during the game. While such carts have eased the burden of carrying the golf bag, it requires the need for additional cost in having a separate piece of equipment. The golfer must therefore transport both the golf bag and golf cart, store them, and continuously manipulate the two separately.

It would be convenient if the golf bag itself would have the ability to be wheeled around the golf course. Present golf bags with wheeling capability provide the wheels on swing arms, and present a further burden to the user when carrying the bag due to the placement of the wheels when not in use. Thus, there is a need for a golf bag which provides the option of rolling the bag across the golf course while keeping the wheels conveniently out of the users way when carrying by hand or over the shoulder.

U.S. Pat. No. 4,382,612 to Larkin, discloses a rollable golf bag having an elongated golf bag container with a collapsible rolling assembly coupled to the container. The collapsible rolling assembly is movable between an extended position to permit rolling of the container, and a folded position to facilitate carrying of the container. Wheels connected on the rolling assembly are detachable and can be stored within a storage compartment of the container.

U.S. Pat. No. 4,822,071 to Widegren discloses a golf bag unit having extendible and retractable travelling wheels. The golf bag has a pull rod hingedly connected to a control rod. The control rod provides for manual compression of the compression spring when the wheels are retracted.

U.S. Pat. No. 3,150,881 to Van Skyock discloses a combination golf bag and cart which forms a complete unit. On one side of the golf bag is a rugged bracket which is fixed to a rigid end panel forming a part of the bag itself. The wheel supporting legs are pivotally mounted on the bracket and held in collapsed and extended positions by a rugged latch structure.

U.S. Pat. Nos. 2,647,762, 2,599,354, 4,890,856 and 5,267,750 to Jamieson et al, Stableford, Mursch et al., and Thompson respectively all disclose a folding golf bag carrier to which a bag may be readily attached to a golf bag. This frame extends the entire length of the bag and is attached to one face thereof. To the other face are pivoted a pair of legs adapted to extend normally downwardly in a divergent manner and having wheels at the bottom thereof. These legs can be collapsible into the golf cart to ease transport when not in use.

U.S. Pat. No. 2,726,094 to Leystra,. discloses an ash can with pivotally supported wheel arms. One end of the wheel arm is attached to the can while the other end attaches to the wheel. In this case, the wheel arm and the wheel can be folded up to a recessed portion on the trash can.

SUMMARY OF THE INVENTION

It is therefore the primary object of the present invention to provide a mobile golf bag that has a telescoping wheel assembly for selectively rolling the golf bag across the ground.

It is another object of the invention to provide a mobile golf bag that overcomes the shortfalls of the prior art.

Yet another object of the invention is to provide a mobile golf bag that operates effectively, efficiently and reliably.

BRIEF DESCRIPTION OF THE DRAWINGS

Other objects and features of the present invention will become apparent from the following detailed description considered in connection with the accompanying drawings which disclose four embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
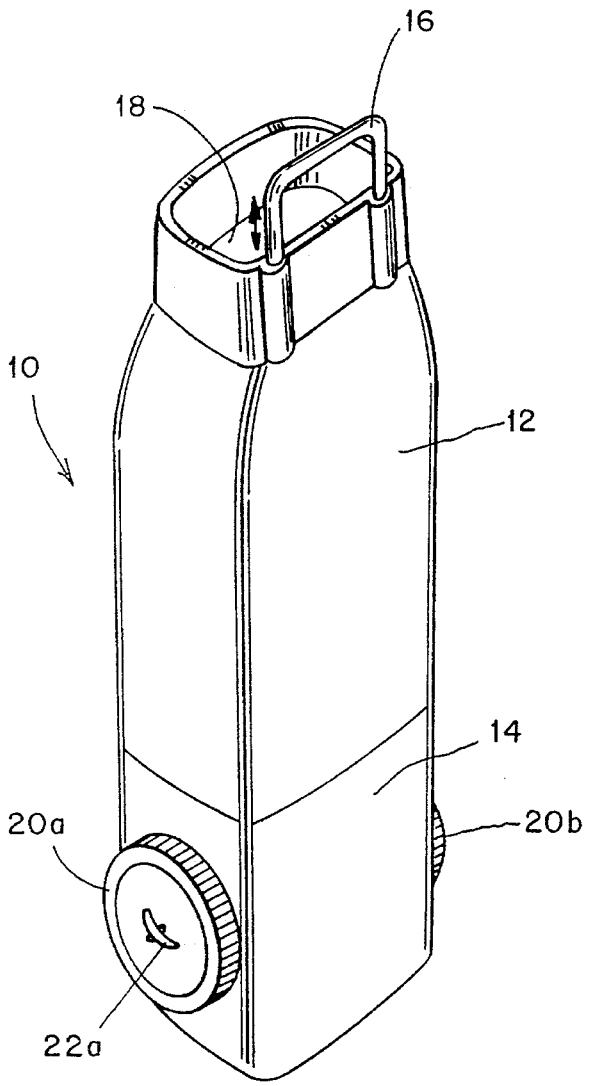
FIG. 1 is a perspective view of a first embodiment of the invention with the wheels retracted.

Turning now in detail to the drawings, FIG. 1 shows the mobile golf bag 10 with an upper portion 12 and a lower portion 14. The upper portion 12 has an opening 18 for receiving golf clubs. Wheels 20*a* and 20*b* are shown in their retracted position and disposed on opposite sides of lower portion 14. An extracting handle 22 provides manual means for extending wheel 20*a* from its retracted position into its extended operable position. A retractable U-shaped pull handle 16 has its straight ends disposed in holes 17 and 19 at the perimeter of opening 18 and allows mobile golf bag 10 to be pulled across the ground and the golf course when the wheels are in their extended operable position. The mobility of golf bag 10 not only aids in movement along the golf course surface, but allows the bag to be rolled to and from the golf course from the owners automobile or elsewhere. Thus, preventing over exertion by the user in getting their golf clubs to the course.

Figure 2:
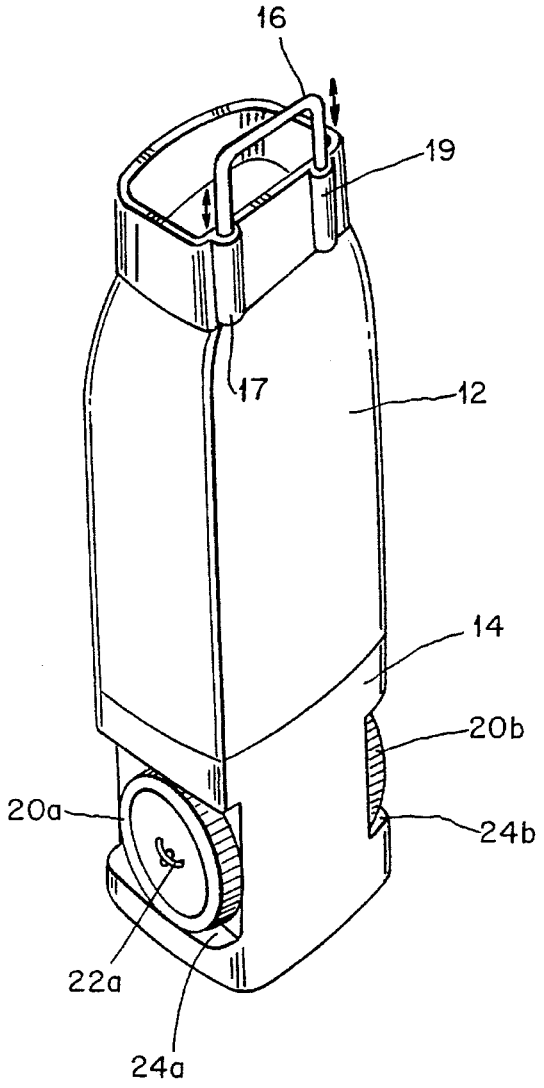
FIG. 2 is a perspective view of a second embodiment of the invention with the wheels retracted.

FIG. 2 shows a second embodiment of the mobile golf bag 10 with recessed portions 24*a* and 24*b* in lower portion 14. Wheels 20*a* and 20*b* are disposed within recessed portions 24*a* and 24*b*, respectively, when said wheels are within the retracted position.

Figure 3:
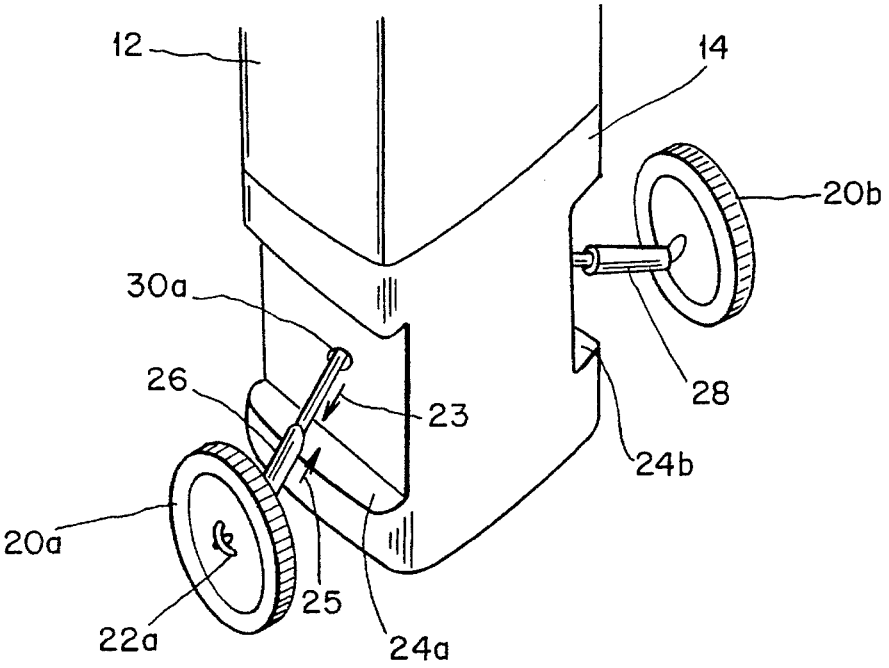
FIG. 3 is a perspective view of the second embodiment with the wheels extended.

FIG. 3 shows the lower portion 14 of the second embodiment of the invention shown in FIG. 2 with wheels 20*a* and 20*b* in their extended operable position. Wheels 20*a* and 20*b* are connected to lower portion 14 through telescoping wheel supports 26 and 28, respectively. Telescoping wheel supports 26 and 28 are connected within lower portion 14 through holes 30*a* and 30*b* (not shown), respectively, in the exterior surface of said lower portion. In this embodiment, hole 30*a* is substantially centrally disposed in recessed portion 24*a*.

Figure 4:
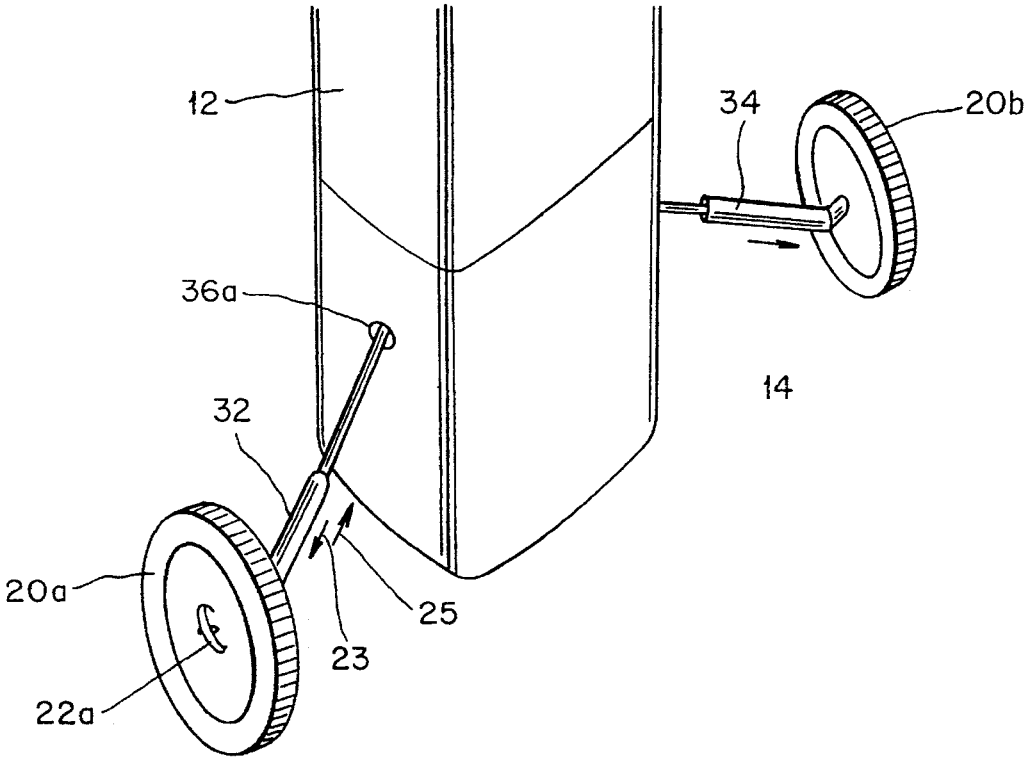
FIG. 4 is a perspective view of the first embodiment with the wheels extended.

FIG. 4 shows the lower portion 14 of the first embodiment of the invention with wheels 20*a* and 20*b* in their extended position. Wheels 20*a* and 20*b* are connected to lower portion 14 through telescoping wheel supports 32 and 34, respectively. Telescoping wheel supports 32 and 34 are connected within lower portion 14 through holes 36*a* and 36*b* (not shown), respectively, in the exterior surface of said lower portion.

Telescoping wheel supports 26, 28, 32 and 34 are piston/cylinders that have a first retracted position and a second extended position. Handles 22*a* and 22*b* (not shown) disposed on wheels 20*a* and 20*b*, respectively, are used to extend and retract telescoping wheel supports 26, 28, 32 and 34. When telescoping wheel supports 26, 28, 32 and 34 are pulled in the direction 23 toward their extended position, at a point in which said wheel supports are approximately half extended, they will automatically extend into their fully extended position. When the telescoping wheel supports are pushed in the direction 25 toward their retracted position, at a point in which said wheel supports are approximately half retracted, they will automatically retract into their fully retracted position.

Figure 5:
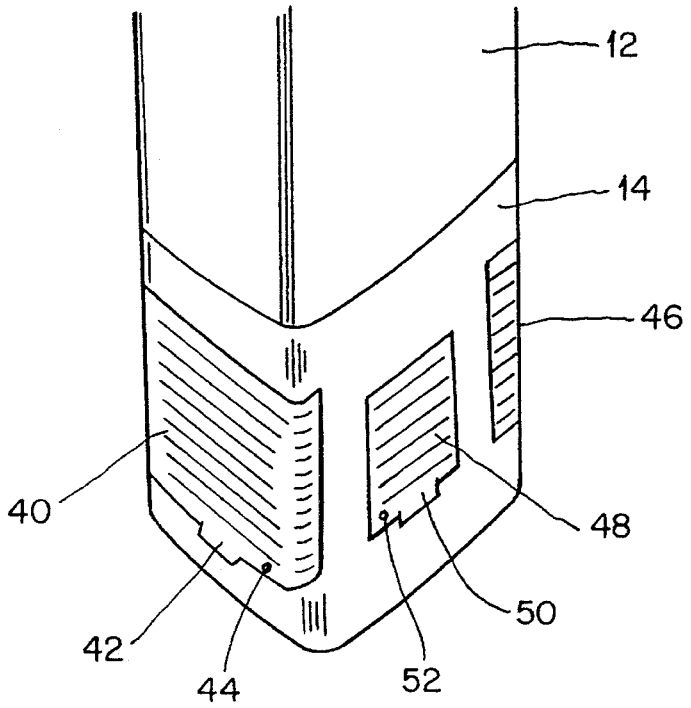
FIGS. 5 & 6 are perspective views of a first embodiment of the retaining means of the invention.
Figure 6:
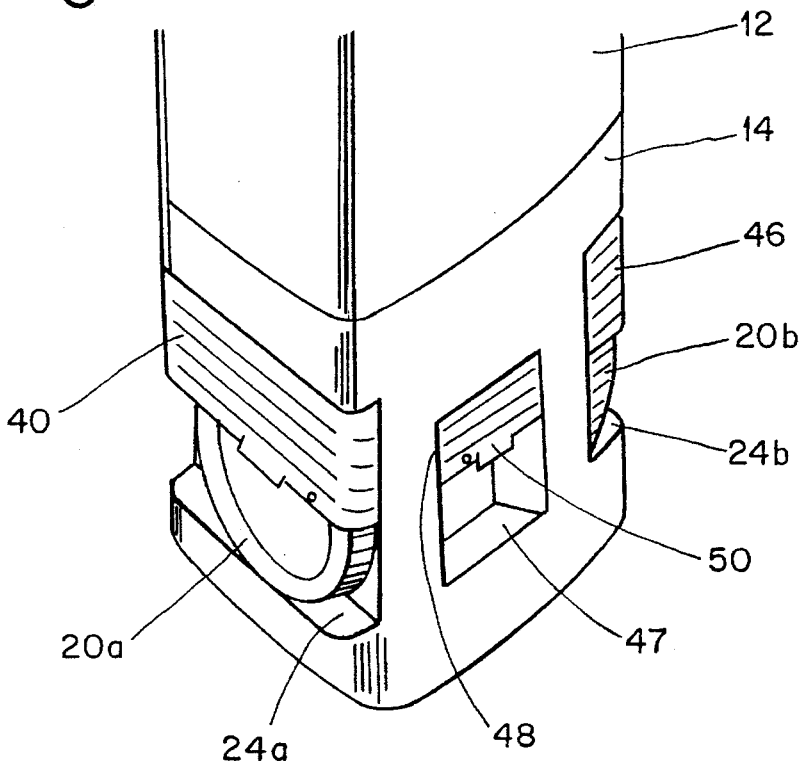

FIGS. 5 and 6 show a third modified embodiment of the invention where the telescoping wheel supports are biased in the extended position and retaining doors 40 and 46 are used to maintain said telescoping wheel supports and wheels 20*a* and 20*b* in their retracted position. Retaining doors 40 and 46 are disposed in lower portion 14 and enclose recessed portions 24*a* and 24*b*, respectively. Retaining doors 40 and 46 are flexible and are slidably mounted within said lower portion. A handle 42 is used to raise and lower retaining door 40 to provide access to wheel 20*a*. A lock 44 within door 40 secures said door in the closed position.

Retaining doors 40 and 46 retain and enclose wheels 20*a* and 20*b*, respectively, within recessed portions 24*a* and 24*b*, respectively. This feature allows for the retention of the wheels in their retracted position while enclosing and preventing any dirt or other foreign material from being discarded from the wheels and recessed portions during times when the golf bag is being carried in a car or other circumstances where the wheels are not being used.

A storage compartment 47 for balls, tees and other accessories, is provided in lower portion 14 and has a flexible door 48 for enclosing said compartment. A handle 50 allows for opening and closing of door 48. A lock 52 secures door 48 in the closed position and prevents unauthorized access thereto.

Figure 7:
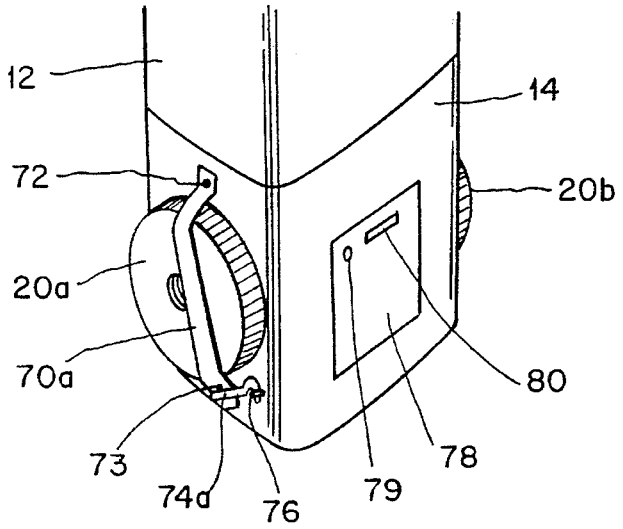
FIGS. 7 & 8 are perspective views of a second embodiment of the retaining means of the invention.
Figure 8:
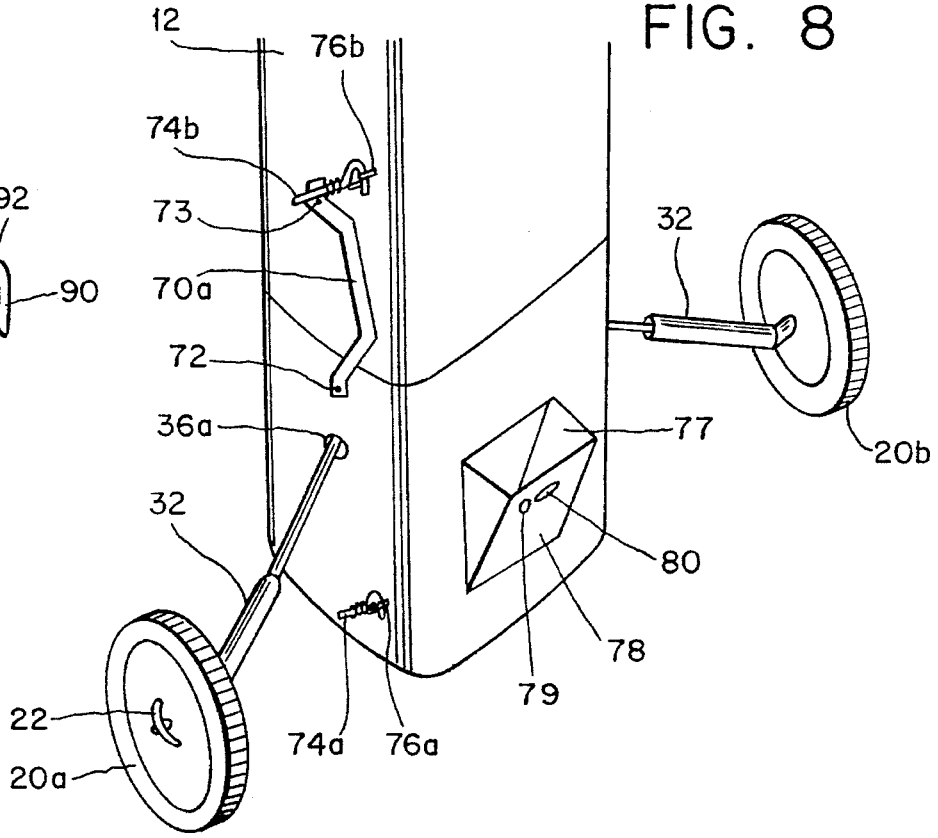

FIGS. 7 and 8 show a fourth modified embodiment of the invention where the telescoping wheel supports are biased in the extended position and U-shaped retaining brackets 70*a* and 70*b* (not shown) are user to retain telescoping wheel supports and wheels in the retracted position. Retaining U-shaped bracket 70*a* is pivotally secured to lower portion 14 at pivot connection point 72. When in the closed position, bracket 70*a* fits over wheel 20*a*, in its retracted position, and is secured to lower portion 14 with a securing pin 74*a* and securing eyelet 76. Securing pin 74*a* and securing eyelet 76 are permanently affixed to lower portion 14 at a point below wheel 20*a* such that bracket 70*a* secures said wheel in the retracted position. In the closed position, bracket 70*a* secures wheel 20*a* against the exterior surface of lower portion 14. Any suitable known fastener capable of securing bracket 70*a* would also be sufficient.

U-shaped retaining brackets 70*a* and 70*b* (not shown) have a second open position whereby wheels 22*a* and 22*b* are in their extended operable position. As shown in FIG. 8, bracket 70*a* is rotated about pivot connection point 72 and secured at its opposite end 73 to upper portion 12 of the golf club container. Securing pin 74*b* and securing eyelet 76*b* secure the opposite end 73 of bracket 70*a* to upper portion 12. When disposed in this second open position, bracket 70*a* can be used as a handle for carrying or moving the golf bag.

A storage compartment 77 is provided in the lower portion 14 and has a front panel 78 flush with the exterior surface of lower portion 14 and a handle for opening and closing said compartment. A lock 79 secures storage compartment 77 in a closed position.

Figure 9:
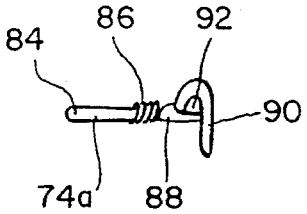
FIG. 9 is a view of the locking means for the second retaining means of the invention.

FIG. 9 shows the securing pin 74*a* of the invention. Securing pin 74*a* has a pivot connection point 84 at which it is connected to the golf bag. A spring 86 and locking member 88 provide a secured loop 92 within hook 90 where a securing eyelet is securely retained. Pin 74*b* has the same configuration as pin 74*a*.

While four embodiments of the present invention have been shown and described, it is to be understood that many changes and modifications may be made thereunto without departing from the spirit and scope of the invention as defined in the appended claims.

What is claimed is:

1. A golf bag with retractable wheel system comprising:

a golf club container having an upper portion and a lower portion, said upper portion having an open top for receiving golf clubs and a retractable U-shaped handle having two legs slidably connected to said upper portion and adjacent said open top for pulling said container, said lower portion having a first side and a second spaced opposite side;

a telescoping wheel assembly coupled to said lower portion of said golf club container, said wheel assembly having a telescoping wheel support disposed on each of said first and second sides of said lower portion, each of said telescoping wheel supports being biased in a first extended position, said telescoping wheel supports being piston-cylinders;

a wheel coupled to each of said telescoping wheel supports; and retaining means for retaining said telescoping wheel supports and wheels in a second retracted position, said retaining means comprising:

a U-shaped bracket having a first end pivotally mounted to said lower portion and a second spaced end; and first locking means disposed on said lower portion for engaging and securing said second end of said U-shaped bracket to said lower portion when said U-shaped bracket is disposed over said wheel when said wheel is in said second retracted position.

2. The mobile golf bag according to claim 1, further comprising second locking means disposed on said upper portion of said club container for engaging and securing said second end of said U-shaped bracket to said upper portion when said telescoping wheel supports and wheels are disposed in said first biased extended position, said second locking means forming said U-shaped bracket into a handle for carrying said golf club container.

3. The mobile golf bag according to claim 1, wherein said lower portion further comprises a third side and a storage compartment, said storage compartment having an access door connected to said third side.

4. The mobile golf bag according to claim 4, wherein said access door is a flexible door slidably mounted within said lower portion, said flexible door having a bottom and a handle connected to said bottom for opening and closing said storage compartment, and a lock disposed in said access door for locking said storage compartment in a closed position.

5. The mobile golf bag according to claim 4, wherein said access door is pivotally mounted to said lower portion, said access door having a handle connected to said access door for opening and closing said door and a lock disposed in said door for locking said door in a closed position.

6. A golf bag with a retractable wheel system for movement along the ground and the surface of a golf course comprising:

a golf club container having an upper portion for receiving golf clubs and a lower portion;

a telescoping wheel assembly coupled to said lower portion of said golf club container, said telescoping wheel assembly having a first retracted position and a second extended position, the wheel assembly comprising:

a first telescoping wheel support comprising:

a first piston having a first end slidably connected to the lower portion of said golf club container and a second opposite end;

a first cylinder having a first open end receiving said second end of said piston and a second opposite end;

a first wheel connected to said second opposite end of said first cylinder;

whereby said piston slidably engages said cylinder and the combination of the piston and cylinder slidably engage the lower portion of said container to place said first telescoping wheel support in said first retracted position;

a second telescoping wheel support comprising:

a second piston having a first end slidably connected to the lower portion of said golf club container opposite said first telescoping wheel support, and a second opposite end;

a second cylinder having a first open end receiving said second end of said piston and a second opposite end;

a second wheel connected to said second opposite end of said second cylinder;

whereby said piston slidably engages said cylinder and the combination of the piston and cylinder slidably engage the lower portion of said container to place said second telescoping wheel support in said first retracted position; and extracting means connected to each of said first and second wheels for extending said first and second telescoping wheel supports into said second extended position.

7. The mobile golf bag according to claim 6, wherein said upper portion further comprises an open top for receiving golf clubs and a retractable U-shaped handle having two legs slidably connected to said upper portion and adjacent said open top for pulling the mobile golf bag across the golf course surface, said lower portion having an exterior surface.

8. The apparatus according to claim 7, wherein said extracting means comprises a handle connected to each of said first and second wheels.

9. The apparatus according to claim 7, wherein said lower portion of said golf club container has a first recessed portion for receiving said first wheel, and a second recessed portion for receiving said second wheel, said recessed portions disposing said wheels flush with said exterior surface of said lower portion when said wheels are in said first retracted position.

10. The apparatus according to claim 9, further comprising a first and second flexible door slidably mounted within said lower portion, said first and second flexible doors enclosing said first and second recessed portions when said wheels are in said first retracted position, said flexible doors having a bottom, a handle connected to said bottom for opening and closing said doors, and a lock disposed in said doors for locking said doors in a closed position.

* * * * *